US006746534B2

(12) United States Patent
Borwig

(10) Patent No.: US 6,746,534 B2
(45) Date of Patent: Jun. 8, 2004

(54) APPARATUS FOR APPLYING GLUE

(75) Inventor: Michael C. Borwig, Sinisher, IA (US)

(73) Assignee: Met-Coil Systems Corporation, Westfield, MA (US)

( * ) Notice: Subject to any disclaimer, the term of this patent is extended or adjusted under 35 U.S.C. 154(b) by 277 days.

(21) Appl. No.: 10/040,744

(22) Filed: Nov. 1, 2001

(65) Prior Publication Data

US 2003/0080205 A1 May 1, 2003

(51) Int. Cl.[7] ..... B05C 11/00

(52) U.S. Cl. ..... 118/58; 118/302; 118/314; 118/315; 118/324; 118/602; 427/345; 427/385.5; 427/422; 427/424

(58) Field of Search ..... 118/58, 302, 314, 118/315, 324, 602; 427/345, 385.5, 422, 424

*Primary Examiner*—Bernard Pianalto

(74) *Attorney, Agent, or Firm*—McCormick, Paulding & Huber LLP

(57) ABSTRACT

An apparatus and method for applying glue is provided in which glue and water are selectively provided to a spray nozzle wherein the water supplied to the nozzle is used to remove any residual glue present after a gluing application. In one preferred embodiment, an outer conduit surrounds an inner conduit defining a first channel therebetween. The inner conduit supplies glue and the first channel supplies water. The outer conduit and the inner conduit are slidably engaged with each other. At least one spray nozzle is in communication with an outer conduit orifice. Slide conduit orifice valving provides selective communication of the outer conduit orifice with an inner conduit orifice and the first channel for selectively supplying glue, water, or neither to the spray nozzle.

15 Claims, 4 Drawing Sheets

APPARATUS FOR APPLYING GLUE

BACKGROUND OF THE INVENTION

The present invention relates to an apparatus and method for applying glue, and, in particular, to an apparatus and method for applying glue through an apparatus having a nozzle which can be purged of glue by the passage of water therethrough.

Current methods of forming ductwork include using a coil line of steel which is bent to form a duct typically 1–2 meters in diameter. Prior to bending the steel, glue is applied to the steel coil for use in adhering insulation to the duct. Typically, a gluing system is installed at the end of the coil line. As a sheet of metal proceeds down the coil line, the glue system applies ribbons of glue to the metal coil passing therebeneath through a tube which has extruding orifices. Thereafter, the insulation is applied to the metal coil.

Conventional gluing systems have disadvantages which limit their usefulness. For example, manual cleaning is typically necessary to remove glue from the extruding orifices. In addition, after the glue is turned off subsequent to a glue application process, there may be as much as a cup of glue left in the extruding line. If the coil line is shut down for any period of time, the glue will harden within the extruding orifices and this requires manual purging of the glue. In order to perform such a purging operation, the extruding orifices need to be taken off (i.e., removed or disconnected from the tube) and placed in a bucket of water to remove the glue. This operation is manually intensive and tends to be messy.

BRIEF SUMMARY OF THE INVENTION

In accordance with the present invention, a glue system is provided for supplying glue through a spray nozzle to a workpiece which includes a water supply for purging residual glue from the spray nozzle after a glue application process. Optimally, the temperature of the glue is maintained at a desired glue temperature to prevent the glue from curing. In addition, optimally, the water is kept at a desired water temperature thereby further aiding to keep the glue at the desired glue temperature and to optimize the purging of glue from the spray nozzle.

In accordance with one aspect of the present invention, an apparatus is provided for applying glue which comprises an outer conduit surrounding an inner conduit, defining a first channel therebetween. The inner conduit supplies glue and the first channel supplies water. The outer conduit and the inner conduit are slidably engaged with one another and the outer conduit has at least one outer conduit orifice. At least one spray nozzle is in communication with a respective outer conduit orifice. A slide conduit orifice valving provides selective communication of the outer conduit orifice with the inner conduit orifice and the first channel.

In one specific embodiment, the slide conduit orifice valving comprises an intermediate conduit disposed between the inner conduit and the outer conduit which is stationary (i.e. secured) relative to the inner conduit. The intermediate conduit has a water orifice in communication with the first channel and the intermediate conduit has a glue orifice in communication with the inner conduit orifice. The outer conduit is slidable relative to the intermediate conduit to selectively align the outer conduit orifice with the glue orifice, the water orifice, or neither orifice.

In accordance with another aspect of the present invention, an apparatus is provided for applying glue which includes an outer conduit surrounding an inner conduit. The inner conduit supplies glue and has at least one inner conduit orifice. The outer conduit has at least one outer conduit orifice. An intermediate conduit is disposed between the inner conduit and the outer conduit. The intermediate conduit defines a first water channel between the intermediate conduit and the inner conduit, and a second water channel between the intermediate conduit and the outer conduit. The intermediate conduit is secured relative to the inner conduit for movement therewith, has a water orifice in communication with the first channel and the second channel, and has a glue orifice in communication with the inner conduit orifice, whereby relative movement of the inner and intermediate conduit relative to the outer conduit is used to selectively align the outer conduit orifice with the glue orifice, with the water orifice or with neither the glue or water orifice. A glue circulation system circulates glue through the inner conduit. A water circulation system supplies water to the first channel and the second channel. At least one nozzle is in communication with the at least one outer conduit orifice. In one further specific embodiment, a plurality of nozzles are provided, each nozzle being associated with a respective one of a plurality of outer conduit orifices.

In accordance with another aspect of the present invention, a method is provided for applying glue to a workpiece including selectively providing glue and water to at least one selected nozzle. Glue is circulated through an inner conduit at a desired glue temperature and water is circulating through a channel defined between the inner conduit and an intermediate conduit at a desired temperature. The intermediate conduit has a glue orifice in communication with the glue and a water orifice in communication with the water. An outer conduit orifice of an outer conduit is selectively aligned with the glue orifice, the water orifice or neither orifice of the intermediate conduit whereby either glue, water or neither is supplied to the outer conduit orifice. Glue is applied to the workpiece when the outer conduit orifice is aligned with the glue orifice by supplying glue from the inner conduit, through the glue orifice, the outer conduit orifice and out a nozzle associated with the outer conduit orifice. Glue is purged from the nozzle when the outer conduit orifice is aligned with the water orifice by supplying water from the first channel and the second channel through the outer conduit orifice and out the nozzle.

In accordance with yet another aspect of the present invention, a method is provided for applying glue to a workpiece including circulating glue through an inner conduit at a desired glue temperature and circulating water through a first channel formed between the inner conduit and an intermediate conduit, and through a second channel formed between an outer conduit and the intermediate conduit. The intermediate conduit has a glue orifice in communication with the glue and a water orifice in communication with the water. An outer conduit orifice of the outer conduit is selectively aligned with the glue orifice, the water orifice or neither orifice of the intermediate conduit by sliding the outer conduit relative to the intermediate conduit whereby either glue, water or neither is supplied to the outer conduit orifice. Glue is applied to the workpiece when the outer conduit orifice is aligned with the glue orifice by supplying glue from the inner conduit, through the glue orifice, the outer conduit orifice and out a nozzle associated with the outer conduit orifice. Glue is purged from the nozzle when the outer conduit orifice is aligned with the water orifice by supplying water from the first channel and the second channel through the outer conduit orifice and out the nozzle.

A key feature of the present gluing system is provided by an automatic water flushing system for purging of glue from the spray nozzles. Preferably, a continuous circulation of water, at a desirable water temperature, is used to purge glue from the spray nozzles. The desired (typically elevated) water temperature helps to maintain the glue at a desired glue temperature and assists in dissolving the glue for better cleaning of the spray nozzle. Further, the continuous circulation of water assists in minimizing the water consumption. An advantage of the automatic water flushing system is an automated and simplified method for clearing the spray nozzles of glue.

An additional feature of the present gluing system is provided by the continuous circulation of glue throughout the gluing system. This continuous circulation prevents inconsistencies in the glue. Further, the circulation of glue prevents build-up of glue within the system. In addition, the present gluing system can be used to maintain the glue at a constant temperature which is desirable in preventing the glue from hardening within the gluing system.

A further feature of the present invention is provided by the slide tube orifice valving. Preferably, the slide tube orifice valving provides a three-position valve for communicating glue, water or neither through the spray nozzles. Further, the slide tube orifice valving provides for airless operation of the spray nozzle when applying glue to a workpiece or during the purging of glue with water. In addition, the slide tube orifice valving provides for minimum glue waste, minimum flushing of the spray nozzles with water, and minimal clogging of the spray nozzles.

Further features and advantages of the present invention will be set forth in, or apparent from, the detailed description of preferred embodiments thereof which follows.

BRIEF DESCRIPTION OF THE SEVERAL VIEWS OF THE DRAWINGS

The invention will now be described in detail with respect to preferred embodiments with respect to the accompanying drawings, wherein.

DETAILED DESCRIPTION OF THE INVENTION

Figure 1:
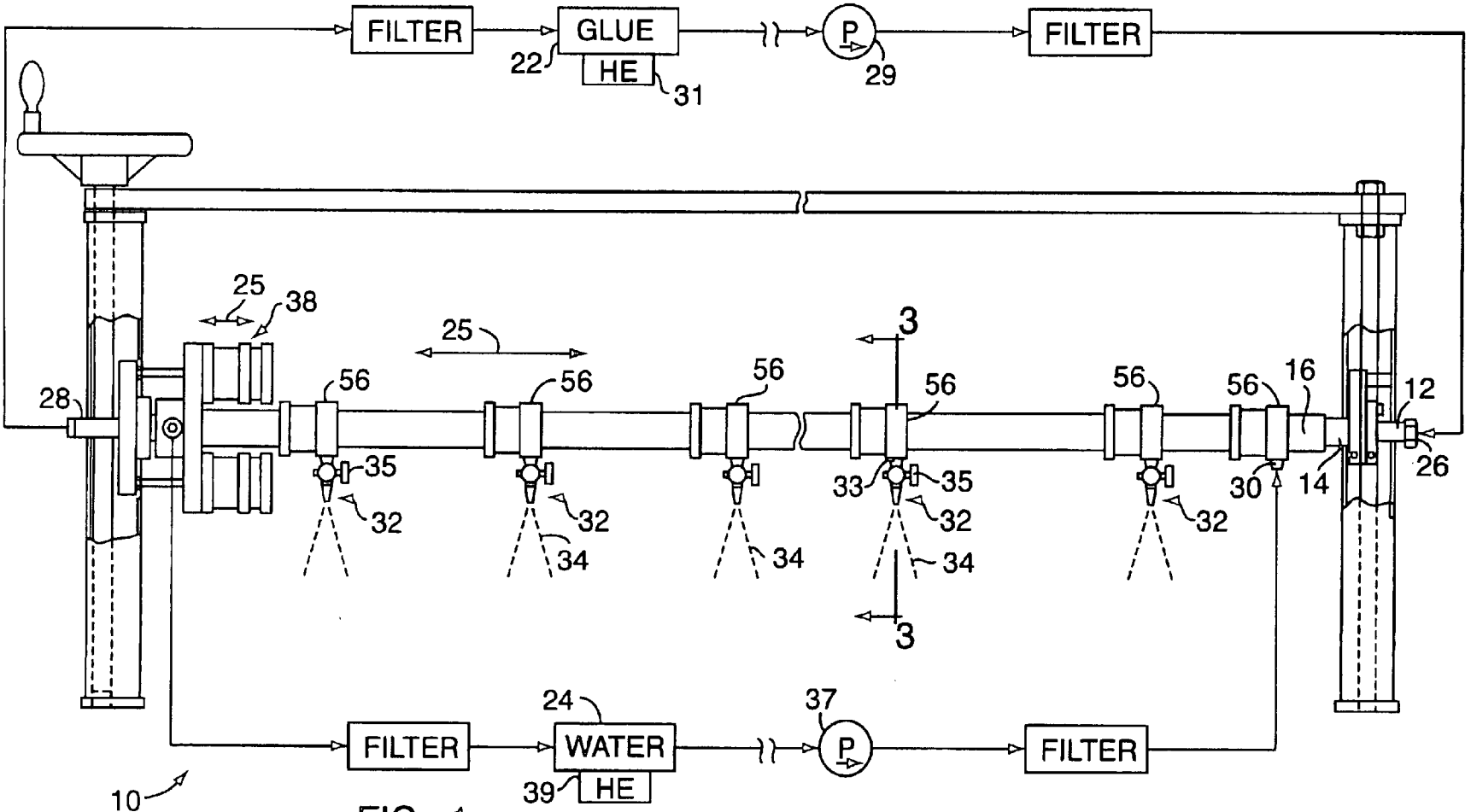
FIG. 1 is an elevational schematic view of a gluing system in accordance with the present invention.

Referring now to FIG. 1, gluing system 10 includes an inner conduit 12, an intermediate conduit 14, and an outer conduit 16. A first channel 18 is formed between intermediate conduit 14 and inner conduit 12. A second channel 20 is formed between outer channel 16 and intermediate channel 14. Inner conduit 12 supplies glue 22. First channel 18 and second channel 20 supply water 24 to gluing system 10. Intermediate conduit 14 is maintained stationary relative to inner conduit 12. Inner conduit 12 and intermediate conduit 14 are slidably disposed relative to outer conduit 16 as denoted by arrow 25.

Glue 22 enters inner conduit 12 through a glue inlet 26 and exits through a glue outlet 28. Water 24 enters first channel 18 and second channel 20 through water inlet 30. Glue 22 or water 24 are selectively provided to nozzles 32 and are expelled as sprays 34 as explained subsequently. A quick release coupler 33 joins nozzle 32 to outer conduit 16, by retainer block 56. The nozzles 32 include a stop valve 35 for selectively turning on and off sprays 34 from selected nozzles 32.

Glue exiting inner conduit 12 through glue outlet 28 is continuously circulated by a suitable low pressure screw pump 29 or the like, i.e., glue 22 re-enters through glue inlet 26. Advantageously, the temperature of the glue is maintained at a desired glue temperature by a suitable heat exchanger 31 (heater, cooler, heat pump, or the like) to prevent glue 22 from hardening within gluing system 10. Optimally, the glue temperature is maintained within the range of 26° C. to 38° C.

Water 24 is continuously circulated through first channel 18 and second channel 20 by a suitable pump 37 or the like. Advantageously, the water is maintained at a desired water temperature by a suitable heat exchanger 39 or the like. Optimally, the water temperature is maintained between 60° C. and 70° C. The desired water temperature helps maintain glue 22 at the desired glue temperature. Further, water 24 at the desired water temperature provides enhanced dissolving of glue for use in purging glue 22 from gluing system 10 and, in particular, from spray nozzles 32.

A three position cylinder 38 actuates the sliding of inner conduit 12/intermediate conduit 14 relative to outer conduit 16 to one of three positions thereby providing a slide tube orifice valving. Depending on the position of the three-position cylinder 38, either glue 22, water 24, or neither is provided to spray nozzles 32.

The three positions of cylinder 38 which provide the slide tube orifice valving will now be described in further detail with reference to FIGS. 2–7. These FIGURES are enlargements of the nozzle 32 flow connections, depicting gluing system 10 in the three positions as noted.

Figure 2:
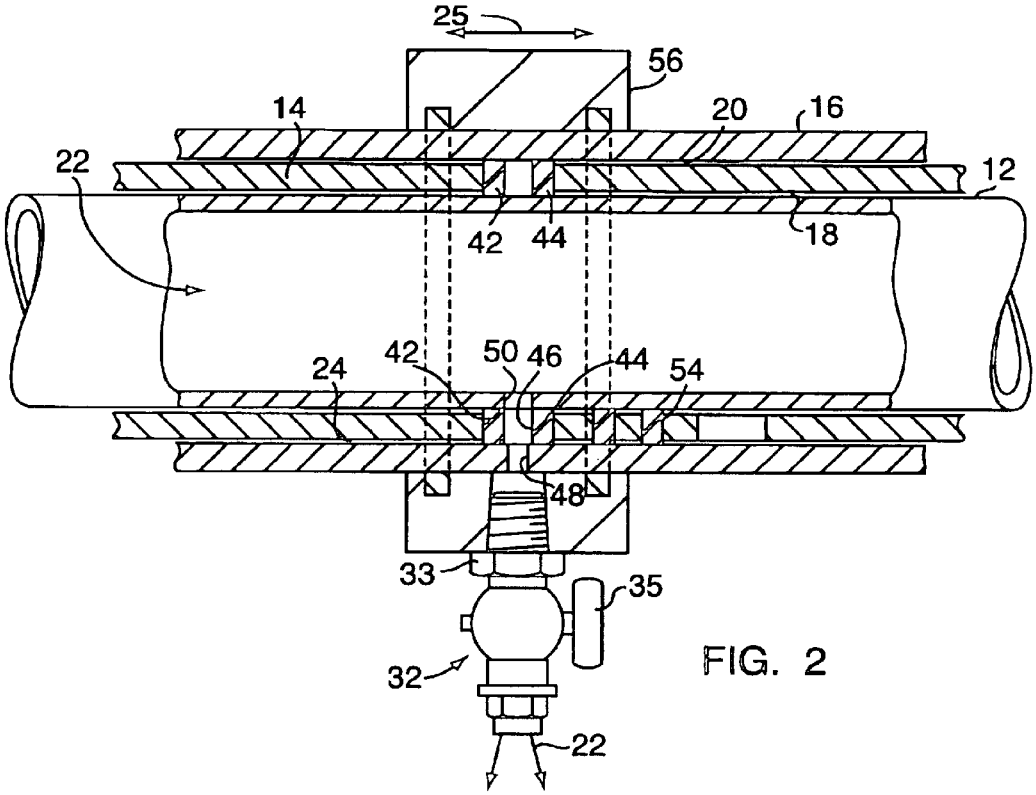
FIG. 2 is an enlarged sectional view of a longitudinal portion of a slide tube orifice valving in a position for supplying glue to the spray nozzles in accordance with the present invention.
Figure 3:
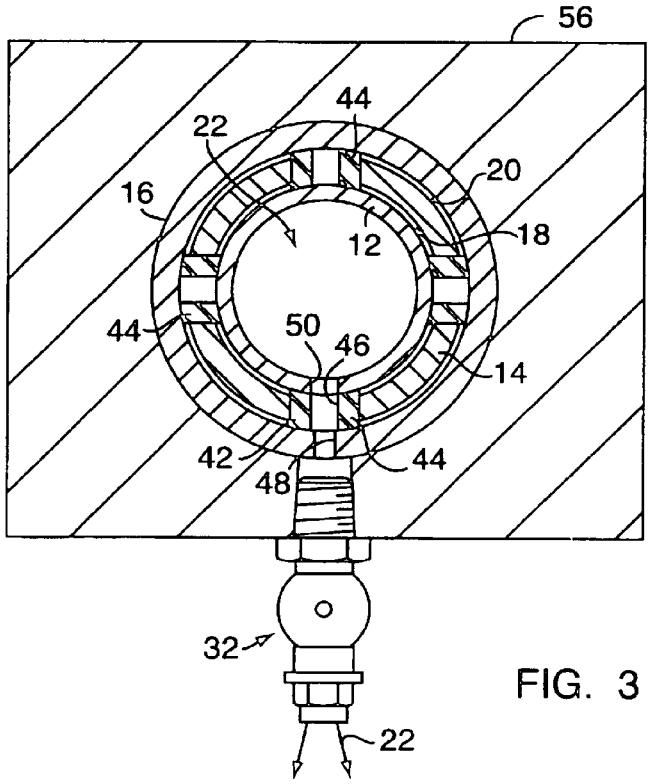
FIG. 3 is a cross-sectional view of the slide tube valving of FIG. 2 along line 3—3.

Referring now specifically to FIGS. 2 and 3, the slide tube orifice valving is depicted in a glue supplying position. O-ring 42 prevents water 24 in channels 18 and 20 from entering glue orifice 46 and outer orifice 48. O-rings 44 are spacers for centering inner conduit 12 within conduit 16.

When applying glue to a workpiece, glue 22 is supplied from inner conduit 12 through an inner conduit orifice 50, glue orifice 46, outer orifice 48 and out through spray nozzle 32. Glue 22 is applied in an airless spray to a workpiece such as a sheet of metal (not shown) located and traveling therebelow. The volume of space from inner orifice 50 through spray nozzle 32 is approximately ¼ cc.

Figure 4:
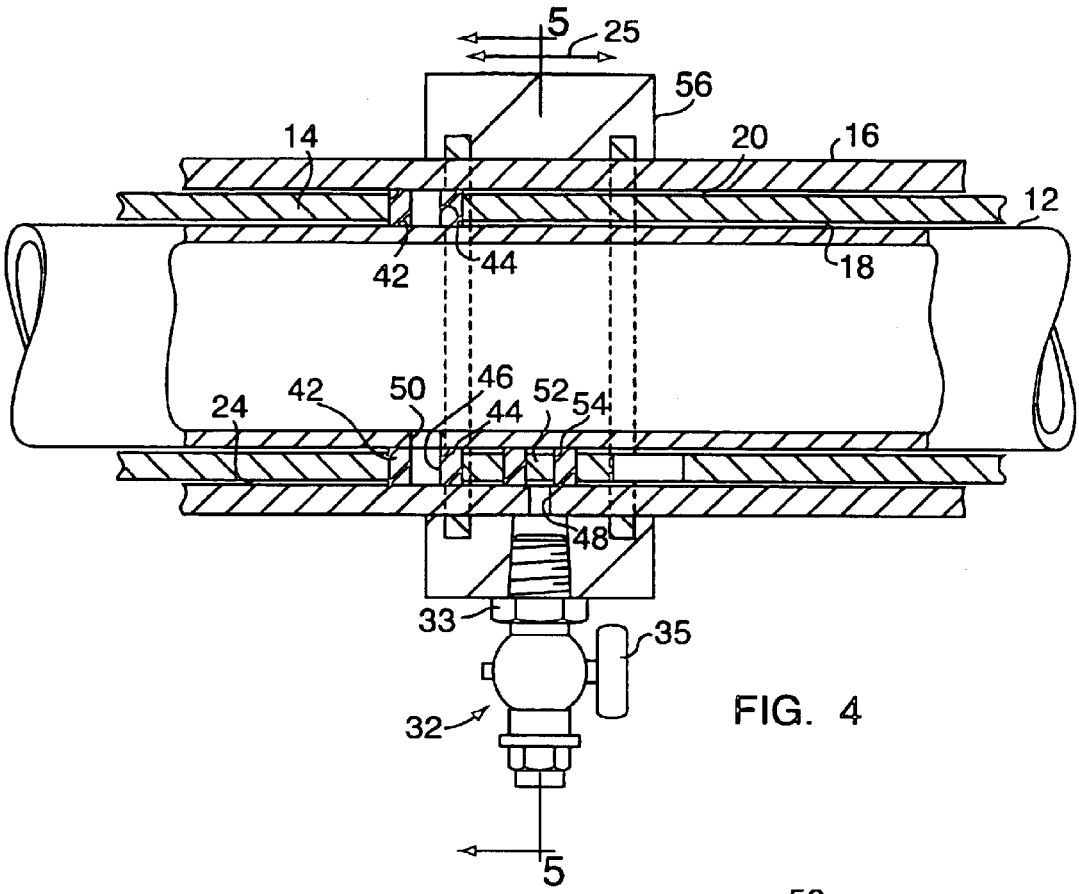
FIG. 4 is an enlarged sectional view of the longitudinal portion of the slide tube orifice valving depicted in FIG. 2 but in a blocked position.
Figure 5:
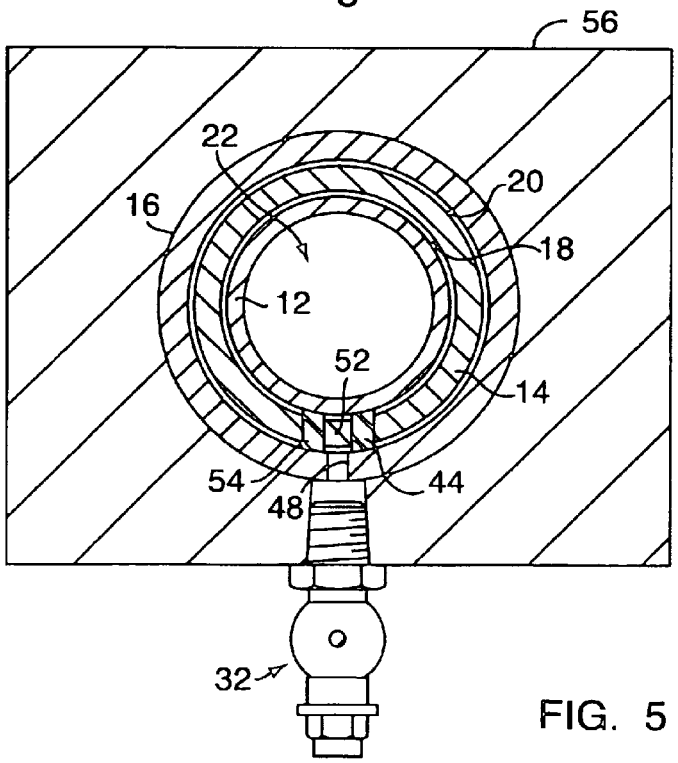
FIG. 5 is a cross-sectional view of the slide tube orifice valving of FIG. 4 along line 5—5.

Referring now to FIGS. 4 and 5, after the glue application process, three-position cylinder 38 (FIG. 1) slides the slide tubing orifice valving to a closed position. Outer conduit 16 is shifted relative to inner conduit 12 and intermediate conduit 14 thereby aligning outer orifice 48 with a block 52. Block 52 is surrounded by O-ring 54 which seals water 24 within first channel 18 and second channel 20 thereby preventing water 24 from entering outer orifice 48 and nozzle 32. In the blocked position, neither glue 22 nor water 24 is supplied to nozzle 32.

Figure 6:
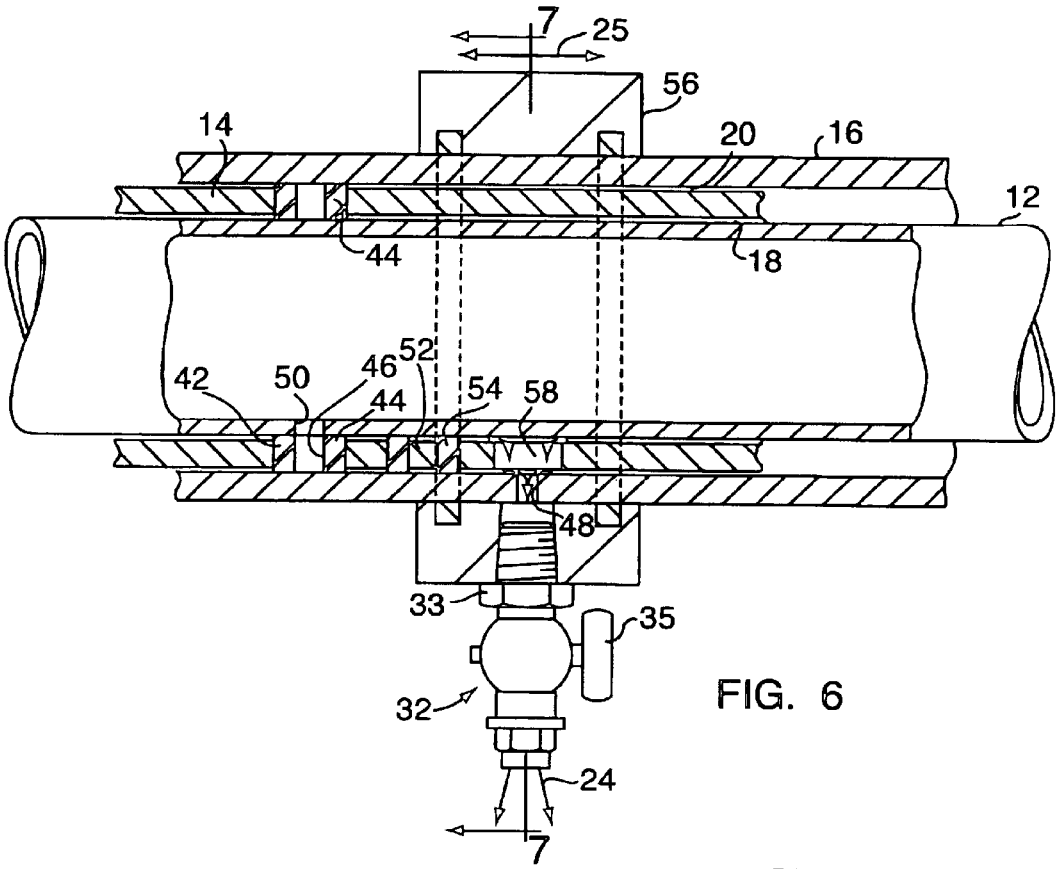
FIG. 6 is an enlarged sectional view of the longitudinal portion of the slide tube orifice valving depicted in FIG. 2 but in a position for supplying water to the nozzles for purging glue.
Figure 7:
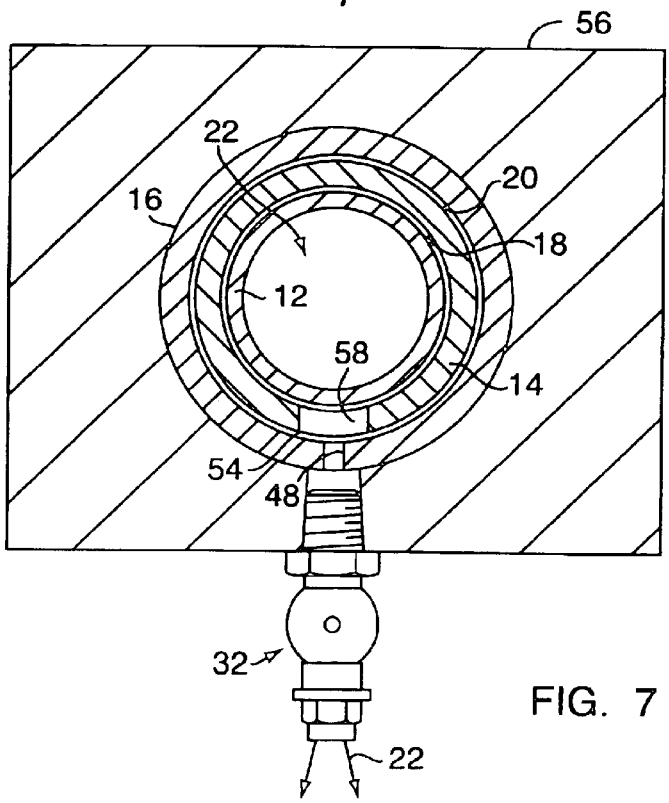
FIG. 7 is a cross-sectional view of the slide tube orifice valving of FIG. 6 along line 7—7.

Referring now to FIGS. 6 and 7, in a third position, i.e., water flushing/glue purging position, three position cylinder 38 (FIG. 1) slides outer conduit 16 into a position aligning outer orifice 48 with water orifice 58. As a result, water 24 flows into water orifice 58 from first channel 18 and second channel 20. The water 24 proceeds through outer orifice 48, and on through nozzle 32 purging any residual glue which may be present as a result of the glue application process. With water 24 at a desired water temperature, the removal of any residual glue is enhanced.

What should now be apparent to one of ordinary skill is that gluing system 10 can be configured for employment and use in applying glue to various workpieces of varying dimensions. For example, selected nozzles 32 may be turned on or off using the respective stop valve 35 to accommodate workpieces of varying size. As a result, gluing system 10 can be configured to direct glue to a specific area thereby accommodating workpieces of various sizes.

In addition, the gluing system 10 may be modified to provide further features and functionality which will be apparent to one of ordinary skill. For example, in-line filters may be provided in the glue circulation system, such as proximate inlet 26 and outlet 28 for filtering glue 22 of any undesirable material, such as hardened glue or other particulate matter. Similarly, the water circulation system may include in-line filters.

Further functionality of gluing system 10 may be provided by selecting a desired spray nozzle for a particular application. For example, spray nozzle 32 is easily removed from gluing system 10 using quick release coupler 33 and replaced with a substitute spray nozzle. The alternative spray nozzles may provide a varying spray area and/or spray volume than the spray nozzles 32.

What will now be apparent to one of ordinary skill in the art are the advantages the present gluing system has over conventional gluing systems. The present gluing system provides for maintaining glue at a desired gluing temperature and an automatic water flushing system for removing residual glue in an automated, operator free process. Further, the water flushing system allows for a minimum water usage. The slide tube orifice valving provides for the airless spray operation of glue and water with minimal or no overspray.

What is claimed is:

1. An apparatus for applying glue, said apparatus comprising:

an outer conduit having at least one outer conduit orifice;

an inner conduit surrounded by said outer conduit and defining a first channel therebetween whereby glue is supplied to said inner conduit and water is supplied to said first channel, said outer conduit and said inner conduit being slideably engaged with each other, and said inner conduit having at least one inner conduit orifice;

at least one spray nozzle in communication with said at least one outer conduit orifice; and a slide conduit orifice valving providing selective communication of said outer conduit orifice with said inner conduit orifice or with said first channel.

2. The apparatus of claim 1, wherein said slide conduit orifice valving comprises an intermediate conduit disposed between said inner conduit and said outer conduit and secured relative to said inner conduit for movement therewith, said intermediate conduit having a water orifice in communication with said first channel and a glue orifice in communication with said inner conduit orifice, whereby relative movement of said inner and intermediate conduits relative to said outer conduit is used to selectively align said outer conduit orifice to said glue orifice, to said water orifice or to neither said glue or water orifice.

3. The apparatus of claim 2, wherein a second channel is formed between said outer conduit and said intermediate conduit to which water is supplied.

4. The apparatus of claim 3, further comprising a water circulation system for supplying water to said first channel and said second channel.

5. The apparatus of claim 4, wherein said water circulation system includes a heat exchanger which provides water at a desired water temperature to assist in maintaining the glue at a desired glue temperature.

6. The apparatus of claim 1, further comprising a glue system for circulating glue through the inner conduit.

7. The apparatus of claim 6, wherein said glue circulation system includes a heat exchanger for maintaining the glue at a desired glue temperature.

8. The apparatus of claim 1, further comprising a water circulation system for supplying water to said first channel.

9. The apparatus of claim 8, wherein said water circulation system includes a heat exchanger which provides water at a desired water temperature to assist in maintaining the glue at a desired glue temperature.

10. The apparatus of claim 1, further comprising a stop valve disposed between said at least one spray nozzle and said outer conduit orifice.

11. An apparatus for applying glue, said apparatus comprising:

an outer conduit surrounding an inner conduit which said inner conduit is supplied with glue, said outer conduit having at least one outer conduit orifice and said inner conduit having at least one inner conduit orifice;

an intermediate conduit disposed between said inner conduit and said outer conduit, said intermediate conduit defining a first water channel between said intermediate conduit and said inner conduit and a second water channel between said outer conduit and said intermediate conduit, being secured relative to said inner conduit for movement therewith, having a water orifice in communication with said first channel and said second channel, and a glue orifice in communication with said inner conduit orifice, whereby relative movement of said inner and intermediate conduit relative to said outer conduit is used to selectively align said outer conduit orifice with said glue orifice, with said water orifice or with neither said glue or water orifice;

a glue circulation system for circulating glue through the inner conduit;

a water circulation system for supplying water to said first channel and said second channel; and at least one spray nozzle in communication with a respective said at least one outer conduit orifice.

12. The apparatus of claim 11, wherein:

said at least one outer conduit orifice comprises a plurality of outer conduit orifices; and said at least one nozzle comprises a plurality of nozzles, each associated with a respective one of said plurality of outer conduit orifices.

13. The apparatus of claim 12, further comprising a respective stop valve disposed between each of said nozzles and each respective said outer conduit orifice.

14. The apparatus of claim 11, wherein said water circulation system includes a heat exchanger which provides water at a desired water temperature to assist in maintaining the glue at a desired glue temperature.

15. The apparatus of claim 11, wherein said glue circulation system includes a heat exchanger for maintaining the glue at a desired glue temperature.

* * * * *